US005118989A

United States Patent [19]

Egermeier et al.

[11] Patent Number: 5,118,989

[45] Date of Patent: Jun. 2, 1992

[54] SURFACE DISCHARGE RADIATION SOURCE

[75] Inventors: John C. Egermeier, Vienna, Va.; Michael G. Ury, Bethesda, Md.

[73] Assignee: Fusion Systems Corporation, Rockville, Md.

[21] Appl. No.: 447,127

[22] Filed: Dec. 11, 1989

[51] Int. Cl.[5] ..... H01J 17/04

[52] U.S. Cl. ..... 313/631; 313/36; 313/632; 313/634; 313/635

[58] Field of Search ..... 313/631, 634, 607, 632, 313/635, 575, 573, 590, 231.71, 231.61, 352, 355, 34, 36, 40, 587; 340/771, 773

[56] References Cited

U.S. PATENT DOCUMENTS 2,943,223 6/1960 Fay ..... 313/607
3,925,703 12/1975 Schermerhorn ..... 313/587
4,837,484 6/1989 Eliasson et al. ..... 313/36
4,945,290 7/1990 Eliasson et al. ..... 313/631

FOREIGN PATENT DOCUMENTS 53-17058 2/1978 Japan ..... 313/631
53-17060 2/1978 Japan ..... 313/631

*Primary Examiner*—Donald J. Yusko
*Assistant Examiner*—Diab Hamadi
*Attorney, Agent, or Firm*—Pollock Vande Sande & Priddy

[57] ABSTRACT

A surface discharge excimer light source which employs a one sided cell wherein all electrodes and the dielectric are on one side of the discharge space. The light produced by the device is neither shadowed nor attenuated by an electrode, and the electrode temperatures can be closely controlled. The construction of the device eliminates the need to maintain parallelism of the discharge space and close tolerances.

27 Claims, 3 Drawing Sheets

FIG.5
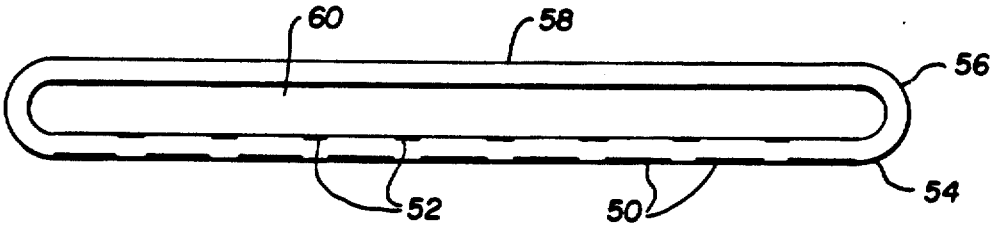
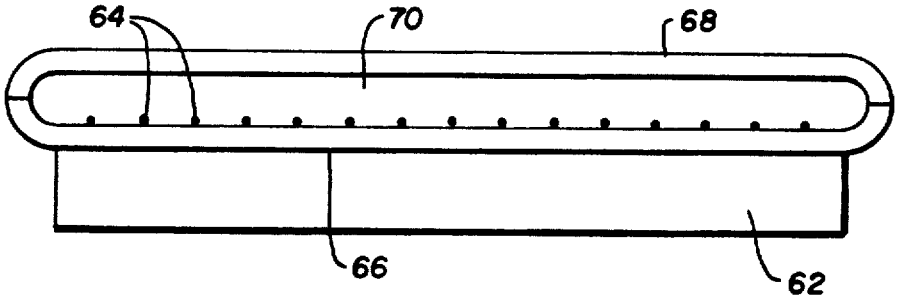
FIG.6
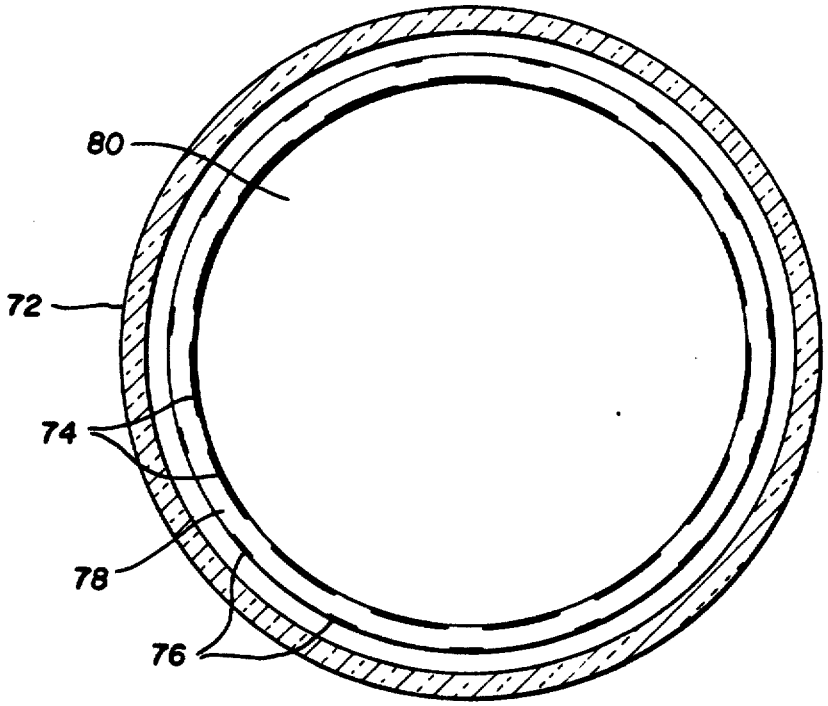
FIG.7

SURFACE DISCHARGE RADIATION SOURCE

BACKGROUND OF THE INVENTION

The present invention is directed to an improved corona discharge radiation source.

It has been known for many years that excimer radiation can be produced by corona discharge in rare gases. For example, see the article by Y. Tanaka, *J. Opt. Soc. Am.* 45, 710–713 (1955). Excimer radiation may characteristically be of relatively narrow bandwidth, and therefore is well suited for certain applications which require narrow bandwidth radiation.

U.S. Pat. No. 4,837,484 to Eliasson et al discloses a corona discharge excimer light source having a structure wherein one of the two electrodes is a wire gauze or screen which allows the light which is emitted by the device to exit. However, a problem with the use of a screen electrode is that the light is masked by the screen with the result that a shadow corresponding to the design of the screen is cast on the target on which the light is imaged. Furthermore, if a metallic, "transparent" electrode is substituted for the screen, the light is attenuated as it passes through the electrode. A further difficulty with the structure which is proposed in U.S. Pat. No. 4,837,484 is that since the screen electrode cannot be obscured, effective temperature control of it is difficult. This may place a limit on the power at which the device can be operated, and will affect the spectral output and efficiency of the device.

Further, the patented design requires that for uniform discharge, good parallelism be held between electrodes over large areas. To do this with a screen requires that the screen be supported by the dielectric, which presents additional design problems.

SUMMARY OF THE INVENTION

It is therefore an object of the invention to provide a corona discharge radiation source which does not mask or shadow the radiation which is emitted by the device.

It is a further object of the invention to provide a corona discharge radiation source with good control of electrode temperatures.

It is a further object of the invention to provide a corona discharge source which does not require parallelism of electrodes or close tolerances.

In accordance with the invention, the above objects are accomplished by using a one sided cell architecture to produce radiation by the corona method. In accordance with this architecture, both electrodes and the intervening dielectric are located on one side of the discharge space. Further, in accordance with the invention, a confinement means is provided for maintaining an excimer forming medium in the discharge space, and at least part of the confinement means may be a window which is arranged to be truly transparent to the light which is produced by the device. One sided cells are known in the art of ozone generating, where oxygen is transported past the cell to form ozone. In such a device, the oxygen is transported by an opaque tube, which maintains it in position to be acted on by the corona discharge.

The advantage of the arrangement of the invention is that there is no screen electrode or partially transparent electrode to shadow or attenuate the light which is produced. Since both electrodes are located on the same side of the discharge, the light produced by the discharge does not have to pass through an electrode or even a window. Further, effective control of electrode temperatures can be achieved by virtue of direct heat conduction through the device in the case where there is no intervening discharge gap, as in the prior art. Additionally, electrodes can be fabricated independently of optical considerations, and the need for a critically adjusted discharge gap is not present.

BRIEF DESCRIPTION OF THE DRAWINGS

The invention will be better understood by referring to the accompanying drawings wherein:

FIGS. 5 and 6 show further embodiments of the invention.

FIGS. 7 and 8 show embodiments of the invention wherein the configuration is cylindrical.

DESCRIPTION OF PREFERRED EMBODIMENTS

Figure 1:
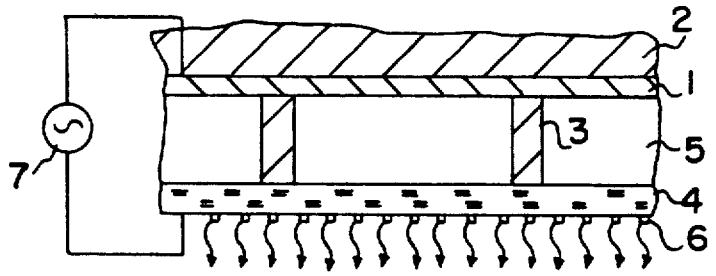
FIG. 1 (PRIOR ART)
FIG. 1 shows a corona discharge radiation source in accordance with the prior art construction.

Referring to FIG. 1, the prior art corona lamp which is the subject of Eliasson U.S. Pat. No. 4,837,484 is illustrated. Referring to the figure, it is seen that the lamp is comprised of a metal electrode 1 which is in contact with a cooling medium 2. There is a dielectric medium 4, which is on the other side of discharge space 5 from electrode 1, and which is spaced by insulating members 3. On the other side of dielectric 4 is screen electrode 6.

The discharge space 5 is filled with a substance which forms excimers under discharge conditions, for example, mercury, xenon, or a noble gas/metal vapor mixture or noble gas/halogen mixture, combined with appropriate additives. As is understood by those skilled in the art, the particular fill is chosen dependent on the spectral output which is desired in the radiation which is produced by the device.

An alternating current source 7 is connected across electrode 1 and gauze or screen electrode 6, which causes micro-discharges to occur in discharge space 5, which excite the excimer forming medium therein. Excimer radiation having a spectral composition corresponding to the fill is thus generated, and exits from the device through screen electrode 6. In the alternative, an electrically conducting layer which has "transparent" properties may be used instead of screen electrode 6.

As mentioned, while the structure described above is effective to produce excimer radiation, a problem is caused by the use of a screen electrode or a thin film metallic electrode which is not completely transparent. Specifically, the screen casts a shadow in the design of the screen on the target on which the light is imaged, while in the case of the thin film electrode, the light is attenuated.

Further, it is seen that the temperature of the high voltage screen electrode is free to change according to heat balance conditions, which can introduce variations in spectral output.

It would be desirable to be able to control the temperature of electrode 6, since cooling will in some cases determine the upper power limit at which the device may be operated. That is, at very high power levels, the device operating temperature will rise. In such case, the device can be operated at higher power levels to provide a higher level of radiation if thermal management could be provided to both electrodes. Also, spectral output of the device is affected slightly by temperature, and changes with time and temperature can be disadvantageous.

Figure 2:
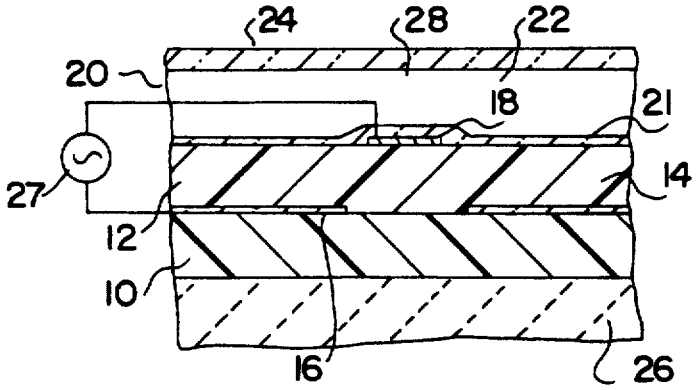
FIG. 2 shows an embodiment of a corona discharge radiation source cell in accordance with the present invention.

Referring to FIG. 2, an embodiment of the present invention is illustrated. The invention utilizes a one sided cell architecture to result in a device which produces a discharge on one side of both electrodes and the dielectric.

Referring to the Figure, members 10 and 12 represent the cross-sections of respective alumina ($Al_2O_3$) bodies. These are very thin, e.g., about 0.02 inches, and the body 10 has electrodes 14 and 16 printed thereon with conductive ink, while body 12 has electrode 18 printed thereon. There is a confinement means 20 above the cell for containing the excimer forming substance 22, which has a window 24 which is transparent to the radiation which is emitted. For example, if the excimer forming fill 22 is chosen so that ultraviolet radiation is emitted, window 24 would be made of quartz, MgF, CaF or other materials which are transparent to UV. A glaze 21 of dielectric may be present over the top of the electrode as well, while a thermal management medium 26 can be applied to the device as shown (i.e., flowing water). When an A.C. voltage from source 27 is applied across electrodes 14 and 16, which may be the ground electrodes, and electrode 18, which would then be the high voltage electrode, an electric field is created in discharge space 28, which causes excimer forming medium 22 to become excited, thus emitting radiation which exits through window 24. The device will also work if the polarity is reversed (i.e., electrode 18 is ground and electrodes 14 and 16 are high voltage).

The operation of the device in FIG. 2 is more clearly explained by reference to FIG. 3. Referring to the Figure, it is seen that when a voltage is applied between base electrode 14, and 16 and electrode 18, an electric field is created between these two electrodes. Part of this electric field is present in the dielectric 12, but part of it, as shown in the Figure, extends into discharge space. When the field strength in the discharge space reaches the corona inception potential on any given cycle, a plasma is struck in that region. Because a plasma is equipotential throughout the plasma space, the plasma itself has the ability to conduct high voltage power, thereby effectively widening the exposed electrode. The plasma thus propagates across the surface of the dielectric wherever it is underlain by the base electrode. The plasma, which may tend to form streamers, can in some cases be directed with the use of magnets. Electrode 18 is ideally located close to the surface of dielectric 12, as if it is located more into the interior of the dielectric, a greater voltage is necessary to cause the field to extend into the discharge space to excite the medium.

Figure 3:
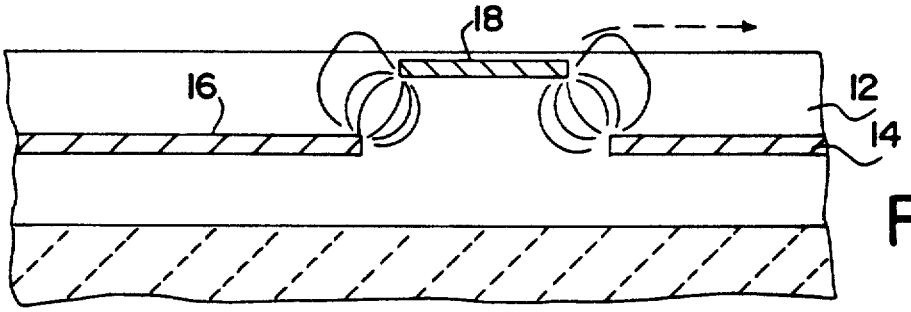
FIG. 3 is an illustration of how the device of FIG. 2 operates.

It should be appreciated that the device shown in FIGS. 2 and 3 does not include either a screen electrode or a solid, metallic light-attenuating electrode, and thus solves the problems of shadowing and a light attenuation, which are present in the prior art structure of FIG. 1.

This is because in the light source of the present invention both electrodes are on the same side of the discharge area, and the excimer forming medium is confined in the discharge area by means having a window which is truly transparent to the generated radiation. For example, if the light emitted were ultraviolet the window would be made of quartz, which as is well known, is substantially transparent to UV. In fact, in accordance with the invention, it is only necessary that both electrodes be on the same side of the excimer forming medium, which means that both electrodes can be in the dielectric or abutting the surface of the dielectric, or one electrode can be in the dielectric while the other can be abutting the surface.

Additionally, it is noted that the electrodes and dielectric form an integral unit with no discharge gap therebetween as in the prior art, and so the thermal management of the unit has the effect of controlling both the ground and high voltage electrodes, since the heat balance can be achieved through the solid dielectric by heat conduction.

It is noted that base electrodes 14, 16 and electrode 18 are offset with respect to each other. As used herein, the term "offset" refers to electrodes which are not both directly opposite each other and of the same shape and dimensions. For example, the electrodes in a parallel plate capacitor is an example of electrodes which are not offset. The present invention uses electrodes which are offset, and electrodes which are not offset.

Figure 4:
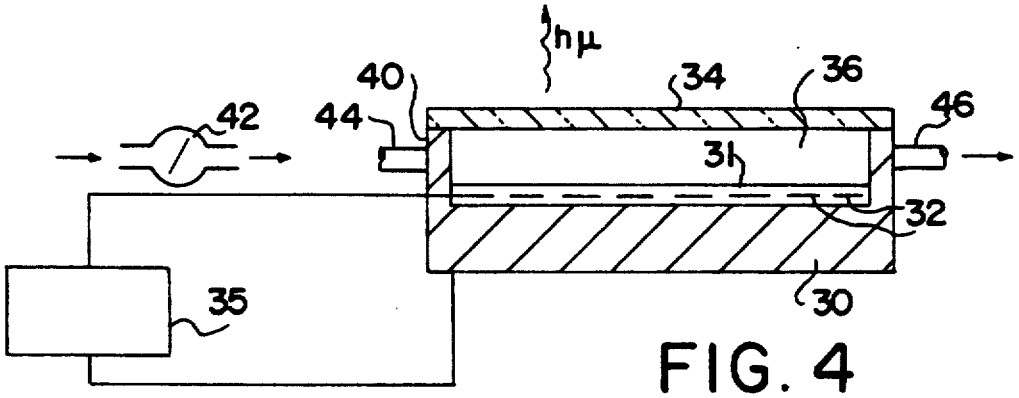
FIG. 4 shows a further embodiment of the radiation source of the invention.

Referring to FIG. 4, a further embodiment of the invention is shown. In this embodiment, a common base electrode 30 is utilized, along with multiple electrodes 32, which are offset from the base electrode. Additionally, the excimer forming substance is confined above the surface of the dielectric, which as shown in the Figure is relatively flat, by means including window 34 which is transparent to the emitted radiation.

In this embodiment, the high voltage electrodes are each comprised of a unit of metallic mesh. The use of mesh electrodes enables the electric field to pass through the spaces in the mesh into the discharge space 36. Thus, the entire surface of the electrodes is utilized to create the initial field in the discharge space instead of just the edges of the electrodes. The term "mesh" includes various structures such as a woven screen, parallel wires, or foil with stamped out holes. The mesh wire gauge and space sizes are slightly dependent on the process conditions and so some variation of these parameters will work. For example, it is believed that wire sizes up to 10 Ga. and meshes having up to 2" spacing may be satisfactory depending on the application.

Thermal management is effected by circulating a temperature controlled fluid within base electrode 30. For example, this can be a separate cooling chuck or can be channels in the electrode through which water is circulated. It can be seen that the temperature control effect is transmitted to the high voltage electrodes by conduction through the dielectric, thus permitting operation of the device at constant temperature.

Base electrode 30 may be in the form of a cup electrode having side walls 40 for supporting transparent window 34. In this case, the means for confining the excimer forming medium near the electrode/dielectric would include the side walls and window. However, as known to those skilled in the art, a variety of specific confinement means may be implemented. Further, the excimer forming fill may reside in the confinement means permanently or semi-permanently, that is the device can be sealed, or in other embodiments, excimer forming medium can be transported through the device when in operation.

This type of device is shown in FIG. 4, wherein the excimer forming medium is metered by mass flow controller 42 and supplied to the device through conduit 44, while the medium is removed from the device through conduit 46.

A reflecting layer may be, disposed between the base electrode 30 and the dielectric 31 for reflecting radiation out of the device. Alternatively, the base electrode can be a metal such as polished aluminum, which will inherently serve as a reflector. If reflection from the base electrode is desired, then the dielectric should be transparent, since the radiation must be reflected through the dielectric. Another possibility is to make the dielectric of a material such as BaO or MgO which does not conduct electricity but which reflects UV down to short wavelengths, or to implant or coat the dielectric with such a substance.

The high voltage mesh electrodes may be made of a variety of metals including tungsten and molybdenum, and may be rectangular in shape. The dielectric may be glass or quartz or other suitable material. A simple way to construct a device as shown in FIG. 4 would be to cement the mesh electrodes between two thin glass and alumina microscope slides, while cementing the resultant assembly to the ground electrode.

It is preferable to select a dielectric material with high dielectric strength and high dielectric constant. High dielectric strength is necessary to stand off the voltages required, and high dielectric constant helps to push the field lines out of the solid into the excimer medium.

BaO and $TiO_2$ are examples of high constant dielectrics, and in the case of $TiO_2$, the highest dielectric constant is found to occur along the C crystal axis.

FIG. 5 shows an embodiment of the invention which is similar to FIG. 2. Electrodes 50 and 52 are embedded in dielectric 54, and member 56 which includes transparent window 58 confines excimer forming substance 60 in the discharge space of the sealed unit.

FIG. 6 shows an embodiment which is similar to FIG. 4. Block electrode 62 and screen electrode 64 abut dielectric 66, while window 68 comprises the means for sealing excimer forming substance 70 in the discharge space.

FIG. 7 shows an embodiment of the invention wherein the configuration is cylindrical. The discharge space is contained between cylindrical shell transparent window 72 and the composite structure comprised of electrodes 74 and 76, and dielectric 78. Thermal management medium 80 is provided at the interior.

Figure 8:
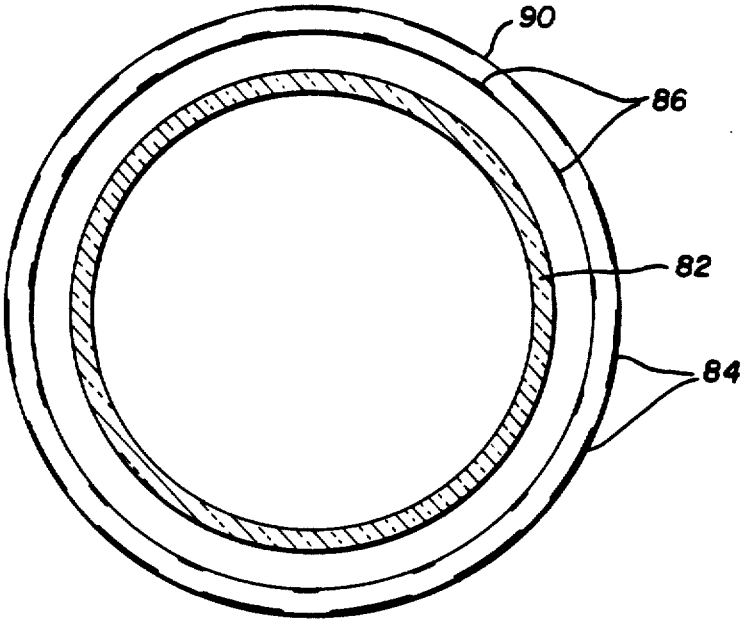

FIG. 8 is a further cylindrical embodiment wherein the radiation exits through window 82 to the interior of the unit. The remaining structure is similar to FIG. 7, with thermal management being at the exterior of the unit. The electrodes in the cylindrical embodiments run lengthwise along the cylinder.

Figure 9:
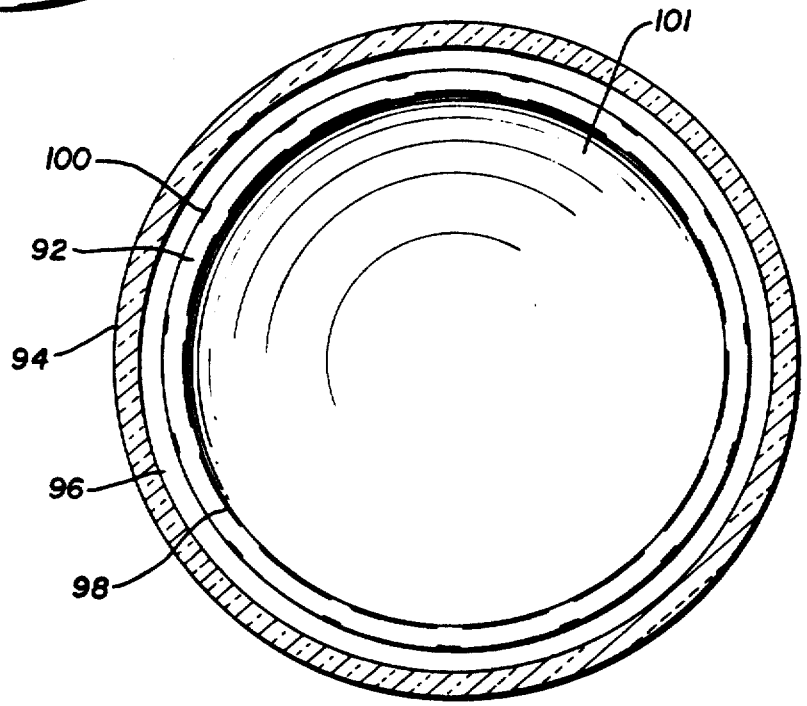
FIG. 9 shows an embodiment of the invention wherein the configuration is spherical.

FIG. 9 is a cross-section of a spherical configuration. Dielectric 92 and window 94 are in the form of spherical shells, and radiation from discharge space 96 would be in the form of a spherical shell. Electrodes 98, 100 would form lines or a grid around the sphere, and thermal management medium 101 might be water circulating in a metal ball. A spherical configuration radiating to the inside would also be possible. Note that in all of the foregoing embodiments of planar, cylindrical and spherical shape, the base electrode can be internal or external to the dielectric and either continuous or discontinuous.

Figure 10:
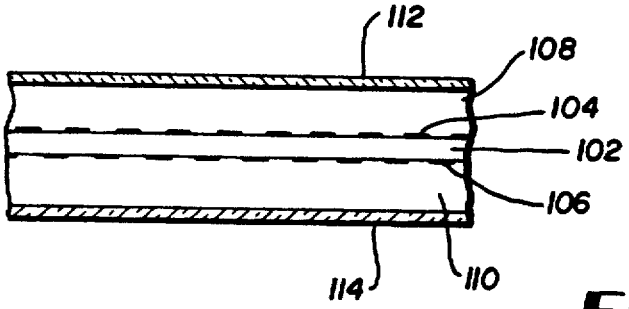
FIG. 10 shows a further embodiment which radiates out of both sides of the device.

FIG. 10 shows a further embodiment of the invention, wherein radiation is emitted from both sides of the device. Opaque or transparent dielectric 102 is provided which has electrodes 104 and 106. Discharge spaces 108 and 110 are provided on either side of the dielectric, which are bounded by windows 112 and 114. The excimer gas mixtures in the discharge spaces can be the same or different, for example, if different, a broader spectral output or multiple peaks can be obtained. Additionally, the gas in space 108 can be a non-excimer gas or even a vacuum. In further variations, one of the windows can have a reflective coating on the outside or dielectric barrier can be a window.

It should be appreciated that the discharge conditions may be varied for different applications. In this regard, the pressure of the gas in the discharge space may be varied to optimum, as may the temperature at which the device is operated.

It should be understood that while the invention has been disclosed in connection with illustrative embodiments, variations will occur to those skilled in the art. For example, while the invention has been illustrated with a confinement means for the excimer forming medium having a transparent window, there may be other approaches to transmitting the light out of the discharge space, for example, light conducting fibers. Thus, the invention should be limited only by the claims appended hereto and equivalents.

We claim:

1. A corona discharge light source cell, comprising, dielectric material having a first, relatively flat surface, a first electrode which is disposed in said dielectric material or abutting said first surface thereof, a second electrode which is disposed in said dielectric material spaced from said first electrode or abutting a second surface thereof, said first and second electrodes comprising a pair of electrodes which are spaced from each other only by said dielectric material, said electrodes and dielectric comprising a composite structure, and means for confining an excimer forming substance in a discharge space adjacent said first, relatively flat surface of said dielectric material, there being means in optical communication with said discharge space for transmitting radiation out of said discharge space which is emitted when said excimer forming substance is excited to discharge conditions by applying an A.C. voltage across said first and second electrodes.

2. The light source cell of claim 1 wherein said means for transmitting radiation comprises a part of said means for confining the excimer forming substance in the discharge space.

3. The light source cell of claim 1 further including means for transporting said excimer forming substance through said means for confining.

4. A corona discharge light source cell, comprising, dielectric material having a first, relatively flat surface, a first electrode which is disposed in said dielectric material or abutting said first surface thereof, a second electrode which is disposed in said dielectric material spaced from said first electrode or abutting a second surface thereof, said first and second electrodes comprising a pair of electrodes which are spaced from each other only by said dielectric material, said electrodes and dielectric comprising a composite structure, and means for confining an excimer forming substance in a discharge space adjacent said first, relatively flat surface of said dielectric material, said confining means having at least a portion which is transparent to the radiation which is emitted when said excimer forming substance is excited to discharge conditions by applying an A.C. voltage across said first and second electrodes.

5. The light source cell of claim 4 wherein the dielectric material is reflective or has a reflective material embedded therein.

6. The light source cell of claim 4 wherein the dielectric material is of high dielectric constant and comprises means for forcing electric field lines into the excimer forming substance.

7. A corona discharge light source cell, comprising, dielectric material, a first electrode which is disposed in said dielectric material or abutting a first surface thereof, a second electrode which is disposed in said dielectric material spaced from said first electrode or abutting a second surface thereof, said first and second electrodes being offset with respect to each other, said first and second electrodes comprising a pair of electrodes which are spaced from each other only by said dielectric material, said electrodes and dielectric comprising a composite structure, and means for confining an excimer forming substance in a discharge space adjacent said composite structure, said confining means having at least a portion which is transparent to the radiation which is emitted when said excimer forming substance is excited to discharge conditions by applying an A.C. voltage across said first and second electrodes.

8. The light source cell of claim 7 wherein said dielectric material is in the form of a dielectric layer, and said electrodes are plane electrodes.

9. The light source cell of claim 7 wherein said dielectric material is in the shape of a cylindrical shell and said means for confining includes a transparent cylindrical shell which is located outside of the discharge space.

10. The light source of claim 7 wherein said dielectric material is in the shape of a cylindrical shell and said means for confining includes a transparent cylindrical shell which is located inside of the discharge space.

11. The light source of claim 7 wherein said dielectric material is in the shape of a spherical shell and said means for confining includes a transparent spherical shell.

12. The light source cell of claim 7 further including a second pair of electrodes which are offset with respect to each other and having only said dielectric material therebetween, wherein one of the electrodes of said pair and second pair of electrodes is the same electrode.

13. The light source cell of claim 12 wherein temperature control is applied to the electrode which is said same electrode.

14. The light source cell of claim 12 wherein there is a radiation reflective surface disposed in said cell.

15. A corona discharge light source cell, comprising dielectric material, first and second electrodes which are disposed in said dielectric material at about the same given plane, but separated from each other, a third electrode which is disposed in said dielectric material at a different plane which is spaced from said given plane, said third electrode being offset with respect to said first and second electrodes, and means for confining an excimer forming substance in a discharge space of said dielectric material, said confining means having at least a portion which is transparent to the radiation which is emitted by said excimer forming substance when an A.C. voltage is applied between said third electrode and said first and second electrodes.

16. The light source cell of claim 15 wherein said third electrode is near the surface of said dielectric material, and said excimer forming substance is adjacent the same surface.

17. A corona discharge light source cell, comprising, a unit of thin dielectric material, a plurality of electrodes disposed in said unit of dielectric material, a common electrode disposed abutting a first surface of said unit of dielectric material, said common electrode extending as far as said plurality of electrodes, said common electrode being spaced from said plurality of electrodes only by said dielectric material, and means for accommodating an excimer forming substance in a discharge space adjacent a first surface of said unit of dielectric material, said accommodating means having at least a portion which is transparent to the radiation which is emitted by said excimer forming substance when an A.C. voltage is applied between said common electrode and said plurality of electrodes.

18. The light source cell of claim 17 wherein said plurality of electrodes comprise mesh electrodes.

19. The light source cell of claim 18 further including means for temperature control of said common electrode.

20. The light source cell of claim 19 wherein said common electrode is made of a metallic material which reflects said radiation.

21. The light source cell of claim 19 wherein said radiation transparent portion comprises a quartz window.

22. The light source of claim 19 wherein said common electrode is the ground electrode and the plurality of electrodes are high voltage electrodes.

23. The light source cell of claim 19 wherein said common electrode is cup shaped, and wherein the side walls of the cup shaped electrode are closed by a layer of radiation transmissive material to form said means for accommodating.

24. The light source of claim 23 further including means for transporting said excimer forming substance through said means for accommodating.

25. A corona discharge light source, comprising, a dielectric material having a first, relatively flat surface, a first electrode which is disposed in said dielectric material or abutting said first surface thereof, a second electrode which is disposed in said dielectric material spaced from said first electrode or abutting a second surface thereof, said first and second electrodes comprising a pair of electrodes which are spaced from each other only by said dielectric material, means for confining an excimer forming substance in a discharge space adjacent said first relatively flat surface of dielectric material, said confining means having at least a portion which is transparent to the radiation which is emitted when said excimer forming substance is excited to discharge conditions, and means for applying a high frequency A.C. voltage across said first and second electrodes for exciting said excimer forming substance to a state where it emits excimer radiation.

26. A corona discharge light source, comprising, a unit of thin dielectric material, a plurality of electrodes disposed in said unit of dielectric material, a common electrode disposed abutting a first surface of said unit of dielectric material, said common electrode extending as far as said plurality of electrodes, said common electrode being spaced from said plurality of electrodes only by said dielectric material, means for accommodating an excimer forming substance adjacent a first surface of said unit of dielectric material, said accommodating means having at least a portion which is transparent to the radiation which is emitted by said excimer forming gas under discharge conditions, and means for applying a high frequency A.C. voltage across said common electrode and said plurality of electrodes.

27. A corona discharge light source cell, comprising, dielectric material, a first electrode which is disposed in said dielectric material or abutting a first surface thereof, a second electrode which is disposed in said dielectric material spaced from said first electrode or abutting a second surface thereof, said first and second electrodes comprising a pair of electrodes which are spaced from each other only by said dielectric material, said electrodes and dielectric comprising a composite structure, first means for confining an excimer forming substance in a first discharge space adjacent said composite structure, said confining means having at least a portion which is transparent to the radiation which is emitted when said excimer forming substance is excited to discharge conditions by applying an A.C. voltage across said first and second electrodes, and second means for confining an excimer forming substance in a second discharge space adjacent said composite structure, and on the other side of said composite structure from where said first discharge space is located, said second confining means having at least a portion which is transparent to the radiation which is emitted when said excimer forming substance is excited to discharge conditions by applying said voltage across said first and second electrodes.

* * * * *